US005663023A

United States Patent [19]

Malhotra

[11] Patent Number: 5,663,023

[45] Date of Patent: Sep. 2, 1997

[54] SIMULATED PHOTOGRAPHIC-QUALITY PRINTS USING A TRANSPARENT SUBSTRATE CONTAINING A WRONG READING IMAGE AND A BACKING SHEET CONTAINING A RIGHT READING IMAGE OF THE SAME INFORMATION

[75] Inventor: Shadi L. Malhotra, Mississauga, Canada

[73] Assignee: Xerox Corporation, Stamford, Conn.

[21] Appl. No.: 583,913

[22] Filed: Jan. 11, 1996

[51] Int. Cl.[6] ..... G03G 15/22

[52] U.S. Cl. ..... 430/97

[58] Field of Search ..... 430/10, 11, 126, 430/68, 54, 97

[56] References Cited

U.S. PATENT DOCUMENTS

| | | | |
|---|---|---|---|
| 4,066,802 | 1/1978 | Clemens | 427/24 |
| 4,249,328 | 2/1981 | Plumadore | 40/159 |
| 4,269,916 | 5/1981 | Bilofsky et al. | 430/11 |
| 4,600,669 | 7/1986 | Ng et al. | 430/47 |
| 4,686,163 | 8/1987 | Ng et al. | 430/47 |
| 4,960,660 | 10/1990 | Dubin et al. | 430/54 |
| 5,065,183 | 11/1991 | Morofuji et al. | 355/202 |
| 5,108,865 | 4/1992 | Zwaldo et al. | 430/126 |
| 5,126,797 | 6/1992 | Forest et al. | 355/278 |
| 5,314,747 | 5/1994 | Malhotra et al. | 428/341 |
| 5,320,902 | 6/1994 | Malhotra et al. | 428/342 |
| 5,327,201 | 7/1994 | Coleman et al. | 355/278 |
| 5,330,823 | 7/1994 | Malhotra | 428/195 |
| 5,337,132 | 8/1994 | Cherian | 355/278 |
| 5,441,795 | 8/1995 | Malhotra et al. | 428/195 |

*Primary Examiner*—John Goodrow

[57] ABSTRACT

Coated sheets or substrates such as paper, opaque Mylar, Teslin or the like are utilized in the creation of simulated, photographic-quality prints formed using non photographic imaging procedures such as xerography and ink jet. A first substrate has a reverse reading image formed thereon. Such an image may be formed using conventional color xerography. A second substrate having a right reading image containing the same information as the first substrate is adhered to the first substrate. The foregoing results in a simulated photographic-quality print which has a relatively high optical density compared to prints using only the reverse reading image on the one substrate.

21 Claims, 2 Drawing Sheets

SIMULATED PHOTOGRAPHIC-QUALITY PRINTS USING A TRANSPARENT SUBSTRATE CONTAINING A WRONG READING IMAGE AND A BACKING SHEET CONTAINING A RIGHT READING IMAGE OF THE SAME INFORMATION

BACKGROUND OF THE INVENTION

The present invention is directed to creating simulated, photographic-quality prints and substrates suitable for use in creating simulated photographic-quality images or prints using non-photographic imaging such as xerography and/or ink jet printing and/or copying. More specifically, the present invention is directed to creating simulated, photographic-quality prints which exhibit an improved optical density.

In the practice of conventional xerography, it is the general procedure to form electrostatic latent images on a xerographic surface by first uniformly charging a charge retentive surface such as a photoreceptor. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past one or more developer housings. In monochromatic imaging, the toner generally comprises black thermoplastic powder particles which adhere to the charge pattern by electrostatic attraction. The developed image is then fixed to the imaging surface or is transferred to a receiving substrate such as plain paper to which it is fixed by suitable fusing techniques.

Recently, there has been a great deal of effort directed to the development of color copiers/printers which utilize the xerographic and/or ink jet imaging process. Such efforts have resulted in the introduction of the Xerox™ 5775™ copier/printer, the Xerox 4900™ and the Fuji Xerox A-Color 635™ machine into the market place.

Notwithstanding all the recent development in the area of color printers and copiers there is room for improvement in the quality of color images on paper and synthetic substrates such as MYLAR and TESLIN. The foregoing is particularly true when trying to create photographic-quality images using non-photographic processes.

Attempts at improving conventionally formed color toner images have led to the lamination of xerographic images on paper using a transparent substrate. This procedure has been only partially successful because the lamination process tends to reduce the density range of the print resulting in a print that has less shadow detail. The lamination process also adds significant weight and thickness to the print.

Additionally, it is believed that the aforementioned lamination process doesn't produce good results because typically the color toner images at the interface between the laminate and the toner do not make suitable optical contact. That is to say, the initially irregular toner image at the interface is still irregular (i.e. contains voids) enough after lamination that light is reflected from at least some of those surfaces and is precluded from passing through the toner. In other words, when there are voids between the transparency and toner image, light gets scattered and reflected back without passing through the colored toner. Loss of image contrast results when any white light is scattered, either from the bottom surface of the transparent substrate or from the irregular toner surfaces and doesn't pass through the toner.

A known method of improving the appearance of color xerographic images on a transparent substrate comprises refusing the color images. Such a process was observed at a NOMDA trade shown in 1985 at a Panasonic exhibit. The process exhibited was carried out using an off-line transparency fuser, available from Panasonic as model FA-F100, in connection with a color xerographic copier which was utilized for creating multi-color toner images on a transparent substrate for the purpose of producing colored slides. Since the finished image from the color copier was not really suitable for projection, it was refused using the aforementioned off-line refuser. To implement the process, the transparency is placed in a holder intermediate which consists of a clear relatively thin sheet of plastic and a more sturdy support. The holder is used for transporting the imaged transparency through the off-line refuser. The thin clear sheet is laid on top of the toner layer on the transparency. After passing out of the refuser, the transparency is removed from the holder. This process resulted in an attractive high gloss image useful in image projectors. The refuser was also used during the exhibit for refusing color images on paper. However, the gloss is image-dependent. Thus, the gloss is high in areas of high toner density because the toner refuses in contact with the clear plastic sheet and becomes very smooth. In areas where there is little or no toner the gloss is only that of the substrate. The refuser was also used during the exhibit for refusing color images on paper.

Following is a discussion of additional prior art which may bear on the patentability of the present invention. In addition to possibly having some relevance to the question of patentability, these references, together with the detailed description to follow, may provide a better understanding and appreciation of the present invention. The prior art discussed herein as well as the prior art cited therein is incorporated herein by reference.

U.S. Pat. Nos. 5,327,201 and 5,337,132 granted to Robert E. Coleman on Jul. 5, 1994 and to Abraham Cherian on Aug. 9, 1994, respectively, disclose the creation of simulated photographic prints using xerography. To this end, reverse reading images are formed on a transparent substrate and a backing sheet is adhered to the transparent substrate.

U.S. Pat. Nos. 4,686,163 and 4,600,669 describe an electrophotographic imaging method that uses an element comprising a photoconductive layer on an electrically conducting substrate capable of transmitting actinic radiation to which the photoconductive layer is responsive, and a dielectric support, releasably adhered to the substrate, comprising the photoconductive layer or an overcoat thereof forming a surface of the element capable of holding an applied electrostatic charge. To use the element, the surface of the dielectric support is charged, and the photoconductive layer is imagewise-exposed to actinic radiation, thereby forming a developable electrostatic image on the dielectric surface. The electrostatic image, in turn, is developed with toner to form a first color image. A composite color image is formed on the element by repeating the sequence one or more times with imagewise exposure of the photoconductive layer to actinic radiation transmitted through the substrate, and developing over each preceding image with a different color toner. The composite tone image is transferred with the dielectric support to a receiving element to form a color copy such as a three-color filter array or a color proof closely simulating the color print expected from a full press run. The dielectric support on the photoconductive layer comprised a transparent blend of (vinylacetate-co-crotonic acid, 95/5 mole ratio) and cellulose acetate butyrate. The resulting multicolor proof presented a multicolor toner image against a white paper background and protected by the overlying dielectric support, thus accurately resembling a multicolor print from a full press run. The receiver element to which the dielectric support and composite toner image are transferred can be any suitable material against or through which the toner image is desired to be viewed. The receiver can be print stock, such as paper, upon which a press run will be conducted. The receiver can also be of transparent material such as a polymeric film. With respect to the latter, the invention also contemplates, as an embodiment, transfer of the composite toner image and dielectric support to image-bearing elements such as microfilm or microfiche so that the composite color image forms information in addition to image information already present on such image-bearing elements. In addition, the invention contemplates the use of transparent glass or non birefringen translucent polymeric materials such as cellulose esters for use as the receiver. Receivers manufactured from such materials are suited for use informing three-color filter arrays by the process described herein involving the formation of filter array matrices of the complementary colorants cyan, magenta and yellow in the respective color toner imaging steps. If desirable, the receiver can also contain a suitable overcoat layer adapted to soften under the influence of pressure and heat during the transfer step. In this manner, the adhesion of the dielectric support and composite toner image to the receiver can be enhanced. The electrophotographic element bearing the multicolor toner image is moved to a separate lamination device comprising heated metal and rubber rolls, together forming a nip. The toner image is passed through the nip with and against a white receiver paper at a roll temperature of 100° C. (212° F.) and a pressure of 225 pounds per square inch to effect transfer of the dielectric support and composite image to the receiver followed by peeling off the rest of the electrophotographic element.

U.S. Pat. No. 4,066,802 granted on Jan. 3, 1978 to Carl F. Clemens discloses a method of decalcomania in which a toner image pattern is formed on a transfer member which has been overcoated with an abhesive material. A polymeric sheet is interposed between the toner image and a cloth or other image receiving medium. The polymeric sheet assists in the permanent adherence of the toner imaging pattern to the cloth material or other medium when the composite is subjected to heat and pressure. The transfer member and method of its use are set forth. Another embodiment discloses the use of a solvent to fix the image to a cloth material.

U.S. Pat. No. 5,065,183 granted on Nov. 12, 1991 to Morofuji et al. discloses a multicolor printing method for printing multicolor picture images upon a material or object to be printed comprises the steps of, in accordance with a first embodiment of the invention, the formation of a multicolor toner image upon a flexible belt by means of electrophotographic printing methods or techniques, and the transfer of such multicolor toner image directly to the material or object to be printed, such as, for example, a container made of, for example, metal, paper, plastic, glass, or the like, by means of a thermo-transferring process. In accordance with a second embodiment of the invention, the multicolor toner image is formed upon a plastic film, which is laminated upon the flexible belt, by means of electrophotographic printing methods or techniques, and the plastic film is then transferred to and fused upon the container. In accordance with a third embodiment of the invention, a photoconductive member is irradiated by means of exposure light upon a rear surface thereof wherein the multicolor picture images are also formed by electrophotographic printing methods or techniques. In this manner, previously formed toner images upon the photoconductive member do not interfere with the image exposure processing.

U.S. Pat. No. 5,126,797 granted on Jun. 30, 1992 to Forest et al. discloses a method and apparatus for laminating toner images wherein a toner image on a receiving sheet is laminated using a transparent laminating sheet fed from the normal copy sheet supply of a copier, printer or the like. The laminating sheet is fed into laminating contact with the toner image after the toner image has been formed on a receiving sheet. The resulting sandwich is fed through the fuser laminating the image between the sheets. The invention is particularly usable in forming color transparencies.

U.S. Pat. No. 5,108,865 granted to Zwaldo et al on Apr. 28, 1992 discloses a method including the steps of: contacting an image (preferably multi-toned image) with a transfer web(intermediate receptor layer) comprising in sequence, a carrier layer, a transferable release layer, and a releasable adhesive layer (releasable from the carrier layer along with the transferable release layer so that both layers transfer at once), said adhesive layer being in contact with said toned image, said contacting being done under sufficient heat and/or pressure to enable said toned image to be adhered to said releasable adhesive layer with greater strength than the adherence of said toned image to said imaging surface of said photoconductive layer; separating the transfer web and said photoconductive layer so that the toned image is removed from said photoconductive layer and remains adhered to the adhesive layer of the transfer web; contacting the surface of the transfer web having both the multi-toned image and adhesive thereon with a permanent receptor removing the carrier layer of the transfer web from the adhesive and the release layer of the transfer web so that an image article is formed of the permanent receptor, multi-toned image, releasable adhesive, and the resultant surface coating of the release layer which is furthest away from the permanent receptor.

U.S. patent application Ser. No. 07/828,821 filed on Jan. 31, 1992 now abandoned discloses a method and apparatus for enhancing color fidelity in a printing process employing an intermediate member wherein a developing unit deposits a colorless and transparent material directly onto an intermediate member before transfer of any color toner images thereto. Alternatively, a developing unit first deposits the colorless and transparent material on a latent image member. The colorless and transparent material is then transferred to the intermediate member before transfer of any color toner images thereto.

U.S. Pat. No. 5,330,823 granted on Jul. 19, 1994 to Shadi L. Malhotra discloses a substantially transparent recording sheet which comprises (a) a substantially transparent substrate; (b) a binder polymer coated on the substrate; and (c) particles of an antistatic component which are present on at least the surface of the binder polymer coating. The ten patents cited in this patent are incorporated herein by reference.

U.S. patent application Ser. No. D/95576 (Attorney's Docket No.) relates to a method and apparatus wherein simulated photographic-quality prints are created using non-photographic imaging such as xerography and ink jet. Reverse reading toner images are formed on a transparent substrate which is adhered to a coated backing sheet. The backing sheet is coated with a polymer material having substantially the same index of refraction as the toner materials used for forming the toner images.

U.S. patent application Ser. No. D/95570 (Attorney's Docket No.) relates to a method and apparatus wherein simulated photographic-quality prints are created using non-photographic imaging such as xerography and ink jet. Reverse or wrong reading toner images are formed on a transparent substrate which is adhered to a coated backing sheet. The backing sheet is coated with a polymer material which serves as an adhesive and has a glass transition temperature less than 55° C. A second coating on the backing sheet which contacts the aforementioned polymer includes a hydrophilic polymer material having a melting point greater than 50° C. and a luminescent materials.

U.S. patent application Ser. No. D/95579 (Attorney's Docket No.) relates to a method and apparatus wherein simulated photographic-quality prints are created using non-photographic imaging such as xerography and ink jet. Reverse or wrong reading toner images are formed on a transparent substrate which is adhered to a coated backing sheet. The backing sheet is coated with a polymer material which serves as an adhesive and has a glass transition temperature less than 55° C. A hydrophilic polymer coating having a melting point greater than 50° C. and a toner plasticizer having a melting point less than 75° C. contacting the adhesive polymer serves as a wetting agent for providing an enhanced optical interface as well as protection for the adhesive polymer which has a lower melting point than the adhesive polymer.

U.S. patent application Ser. No. D/95576Q2 (Attorney's Docket No.) relates to a method and apparatus wherein simulated photographic-quality prints are created using non-photographic imaging such as xerography and ink jet. Reverse or wrong reading toner images are formed on a transparent substrate which is adhered to a coated backing sheet. The backing sheet is coated with a polymer material which serves as an adhesive and has a glass transition temperature less than 55° C. A hydrophilic polymer coating having a melting point less 50° C. contacting the adhesive polymer serves as a wetting agent for providing an enhanced optical interface as well as protection for the adhesive polymer which has a lower melting point than the adhesive polymer.

U.S. patent application Ser. No. D/95580 (Attorney's Docket No.) an apparatus and method for creating color images which are coated with a composition including a lightfastness inducing material and a hydrophobic polymeric binder which protects the images from rough handling and degradation from exposure to UV light.

U.S. patent application Ser. No. D/95582 (Attorney's Docket No.) relates to a method and apparatus wherein coated sheets or substrates such as paper, opaque MYLAR, TESLIN or the like are utilized in the creation of simulated, photographic-quality prints formed using non photographic imaging procedures such as xerography and ink jet. A first substrate which is transparent has a reverse reading image formed thereon. Such an image may be formed using conventional color xerography. A second substrate having a right reading image containing different information from the first substrate is adhered to the imaged side of first substrate. The foregoing results in a simulated photographic-quality print which when viewed through the non-imaged side of the transparent substrate contains all right reading information.

U.S. patent application Ser. No. D/95581 (Attorney's Docket No.) relates to coated sheets or substrates such as paper, opaque MYLAR, TESLIN or the like are utilized in the creation of simulated, photographic-quality prints formed using non photographic imaging procedures such as xerography and ink jet. A first substrate which is transparent has a reverse reading black image formed thereon. Such an image may be formed using conventional monochromatic xerography. A second substrate is xerographically imaged for forming a uniform color image layer thereon. The foregoing results in a simulated color photographic-quality print which when viewed through the non-imaged side of the transparent substrate contains all right reading reading images which exhibit color even though they are formed using black toner.

U.S. patent application Ser. No. D/95577 (Attorney's Docket No.) relates to a method and apparatus wherein simulated photographic-quality prints are created using non-photographic imaging such as xerography and ink jet. Reverse reading toner images are formed on a transparent substrate which is adhered to a coated backing sheet. One side of the backing sheet is adhered to a transparent substrate containing a reverse reading image. The opposite surface of the backing sheet is coated with a hydrophilic material which enables writing on that surface with pen or pencil and printing thereon using xerography or ink jet.

U.S. patent application Ser. No. D/95576Q1 (Attorney's Docket No.) relates to a method and apparatus W, herein simulated photographic-quality prints are created using non-photographic imaging such as xerography and ink jet. Reverse reading toner images are formed on a transparent substrate which is adhered to a coated backing sheet. The backing sheet is coated with a lightfastness material for minimizing degradation of color images exposed to UV light.

U.S. patent application Ser. No. D/95578 (Attorney's Docket No.) relates to a method and apparatus wherein simulated photographic-quality prints having one surface or side of a backing sheet provided with a coating which is scuff resistant and which is receptive to being written on with pen or pencil as well as being receptive to xerographic imaging.

BRIEF SUMMARY OF THE INVENTION

The present invention is directed to using coated sheets or substrates such as paper, opaque MYLAR, TESLIN or the like in the creation of simulated, photographic-quality prints using non photographic imaging procedures such as xerography and ink jet.

In accordance with the invention, a first substrate has a reverse reading image formed thereon. Such an image may be formed using conventional color xerography. A second substrate having a right reading image containing the exact same information as the first substrate is adhered to the first substrate, the wrong reading and right reading images being superimposed. The foregoing results in a simulated photographic-quality print which has a relatively high optical density compared to prints using only the reverse reading image on the one substrate.

Other features of the present invention will become apparent as the following description proceeds and upon reference to the drawings, in which:

DETAILED DESCRIPTION OF THE PREFERRED EMBODIMENT OF THE INVENTION

Figure 1:
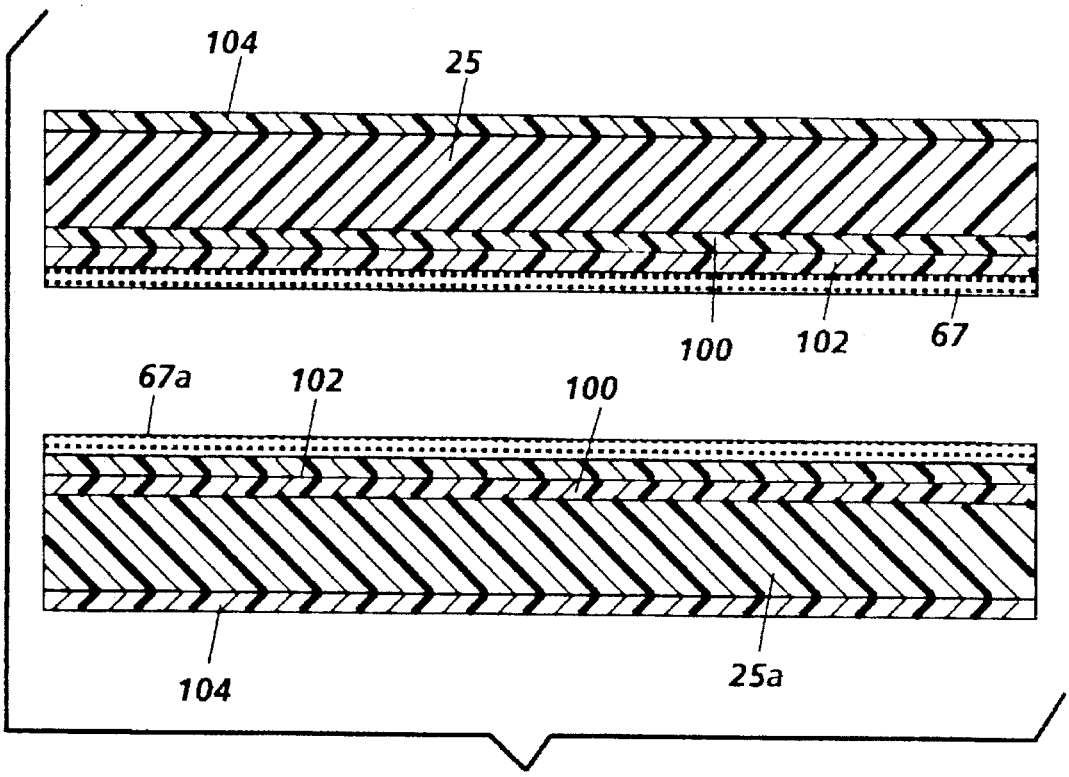
FIG. 1 is an elevational view of a pair of substrates, one a transparency containing a reverse reading image and the other a coated backing sheet used for creating a simulated color, photographic-quality prints.

For a general understanding of the features of the present invention, reference is made to the drawings. In the drawings, like reference numerals have been used throughout to identify identical elements.

While the present invention will hereinafter be described in connection with least one preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. It will become evident from the following discussion that the present invention is equally well suited for use in a wide variety of printing system, and is not necessarily limited in its application to the particular system shown herein.

Figure 2:
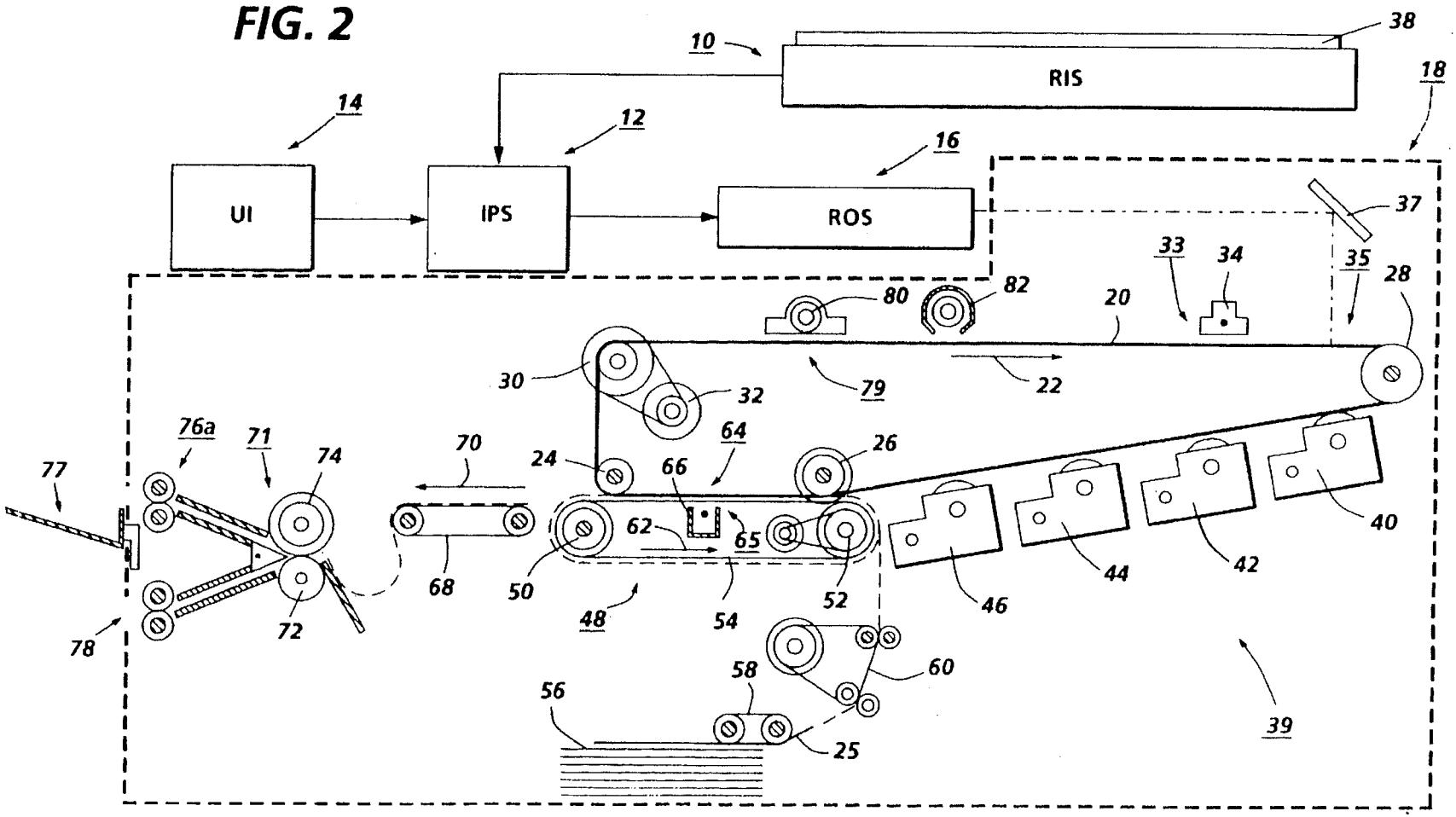
FIG. 2 is a schematic elevational view of an illustrative electrophotographic copier which may be utilized in carrying out the present invention.

Turning initially to FIG. 2, during operation of a printing system 9, a multi-color original document photograph 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. Signals corresponding to the desired image are transmitted from IPS 12 to a ROS 16, which creates the output image. ROS 16 lays out the image in a series of horizontal scan lines with each line having a specified number of pixels per inch. ROS 16 includes a laser having a rotating polygon mirror block associated therewith. ROS 16 is utilized for exposing a uniformly charged photoconductive belt 20 of a marking engine, indicated generally by the reference numeral 18, to achieve a set of subtractive primary latent images. The latent images are developed with cyan, magenta, and yellow developer material, respectively. These developed images are transferred to a final substrate in superimposed registration with one another to form a multi-color image on the substrate. This multi-color image is then heat and pressure fused to the substrate thereby forming a multi-color toner image thereon. The printing system 9 is capable of printing conventional right real toner images on plain paper or mirror images on various other kinds of substrates utilized in the commercially available 5775™ copier. With continued reference to FIG. 2, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the surface sequentially through the various processing stations d posed about the path of movement thereof. Photoconductive belt 20 is entrained about transfer rollers 24 and 26, tensioning roller 28, and drive roller 30. Drive roller 30 is rotated by a motor 32 coupled thereto by suitable means such a belt drive. As roller 30 rotates, it advances belt 20 in the direction of arrow 22.

Initially, a portion photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-color original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with a rotating polygon mirror block. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12.

According to the present invention, the document 38 preferably comprises a black and white or color photographic print. It will be appreciated that various other documents may be employed without departing from the scope and true spirit of the invention.

After the electrostatic latent images have been recorded on photoconductive belt 20, the belt advances such latent images to a development station, indicated generally the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to a compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be use to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This ensures that each electrostatic latent image is developed with to toner particles of the appropriate color without commingling.

It will be appreciated by those skilled in the art that scavengeless or non-interactive development systems well known in the art could be used in lieu of magnetic brush developer structures. The use of non-interactive developer systems for all but the first developer housing would make it unnecessary for movement of the developer housings relative to the photoconductive imaging surface.

After development, the toner image is moved to a transfer station, indicated generally by the reference numeral 65. Transfer station 65 includes a transfer zone, generally indicated by reference numeral 64. In transfer zone 64, the toner image is transferred to a transparent substrate 25. At transfer station 65, a substrate transport 25, indicated generally by the reference numeral 48, moves the substrate 25 into contact with photoconductive belt 20. Substrate transport 48 has a pair of spaced belts 54 entrained about a pair of substantially cylindrical rollers 50 and 52. A substrate gripper (not shown) extends between belts 54 and moves in unison therewith. The substrate 25 is advanced from a stack of substrates 56 disposed on a tray. A friction retard feeder 58 advances the uppermost substrate from stack 56 onto a pre-transfer transport 60. Transport 60 advances substrate 25 to substrate transport 48. Substrate 25 is advanced by transport 60 in synchronism with the movement of substrate gripper, not shown. In this way, the leading edge of substrate 25 arrives at a preselected position, i.e. a loading zone, to be received by the open substrate gripper. The substrate gripper then closes securing substrate 25 thereto for movement therewith in a recirculating path. The leading edge of substrate 25 is secured releasably by the substrate gripper. As belts 54 move in the direction of arrow 62, the substrate moves into contact with the photoconductive belt, in synchronism with the toner image developed thereon. At transfer zone 64, a corona generating device 66 sprays ions onto the backside of the substrate so as to charge the substrate to the proper electrostatic voltage magnitude and polarity for attracting the toner image from photoconductive belt 20 thereto. The substrate remains secured to the substrate gripper so as to move in a recirculating path for three cycles. In this way, three different color toner images are transferred to the substrate in superimposed registration with one another to form a composite multi-color image 67, FIG. 1.

Referring again to FIG. 2 one skilled in the art will appreciate that the substrate may move in a recirculating path for four cycles when under color removal and black generation is used and up to eight cycles when the information on two original documents is being merged onto a single substrate. Each of the electrostatic latent images recorded on the photoconductive surface is developed with the appropriately colored toner and transferred, in superimposed registration with one another, the substrate to form a multi-color facsimile of the colored original document. As may be appreciated, the imaging process is not limited to the creation of color images. Thus, high optical density black and white simulated photographic-quality prints may also be created using the process disclosed herein.

After the last transfer operation, the substrate gripper opens and releases the substrate 25. A conveyor 68 transports the substrate, in the direction of arrow 70, to a heat and pressure fusing station, indicated generally by the reference numeral 71, where the transferred toner image is permanently fused to the substrate. The fusing station includes a heated fuser roll 74 and a pressure roll 72. The substrate passes through the nip defined by fuser roll 74 and pressure roll 72. The toner image contacts fuser roll 74 so as to be affixed to the transparent substrate. Thereafter, the substrate is advanced by a pair of rolls 76 to an outlet opening 78 through which substrate 25 is conveyed. Alternatively, the substrates can be advanced by a pair of rollers **76*a* to a catch tray 77**.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

According to the present invention, the composite toner image 67 when formed on the photoconductive belt 20 is a right reading image so that after transfer thereof, to a transparent substrate, the image represents a wrong or reverse reading multi-color toner image when viewed from the toner side of the transparent substrate 25 and is right reading when viewed through the opposite or non-imaged side of the transparent substrate. Further in accordance with the present invention, a second composite multi-color image **67*a* containing the exact same information as the wrong reading image is formed on a transparent substrate 98 (FIG. 1). In forming the image 67*a*, the printing system 9 is programmed to form a right reading image on the substrate 98 as viewed from the image side thereof. As will be discussed hereinafter, the two substrates 25 and 98** are adhered to each other with the reverse reading and right reading images superimposed whereby print with superior optical density is provided.

A process and apparatus for forming simulated photographic-quality prints which use the transparencies 25 and 98 containing the composite, reverse reading color image 67 and t composite right reading color image **67*a*** is disclosed in U.S. Pat. No. 5,337,132 granted to Abraham Cherian on Aug. 9, 1994. Alternatively, simulated photographic-quality prints may be created using the apparatus and method described in U.S. Pat. No. 5,327,201 granted to Coleman et al on Jul. 5, 1994.

The substrates or sheets of the present invention comprise a substrate or base sheet having a coating on one or both sides thereof. Any suitable substrate material can be employed. Examples of substantially transparent substrate materials include polyesters, including MYLAR, available from E. I. Du Pont de Nemours & Company, MELINEX, available from Imperial Chemicals, Inc., CELANAR, available from Celanese Corporation, polyethylene naphthalares, such as Kaladex PEN films, available from Imperial Chemical Industries, polycarbonates such as LEXAN, available from General Electric Company, polysulfones, such as those available from Union Carbide Corporation, polyether sulfones, such as those prepared from 4,4'-diphenyl ether, such as UDEL, available from Union Carbide Corporation, those prepared from disulfonyl chloride, such as VICTREX, available from ICI Americas Incorporated, those prepared from biphenylene, such as ASTREL, available from 3M Company, poly (arylene sulfones), such as those prepared from crosslinked poly(arylene ether ketone sulfones), cellulose triacetate, polyvinylchloride cellophane, polyvinyl fluoride, polyimides, and the like, with polyester such as MYLAR being preferred in view of its availability and relatively low cost. The substrate can also be opaque, including opaque plastics, such as TESLIN, available from PPG Industries, and filled polymers, such as MELINEX, available from ICI. Filled plastics can also be employed as the substrate, particularly when it is desired to make a "never-tear paper" recording sheet. Paper is also suitable, including plain papers such as XEROX 4024, diazo papers, or the like.

The substrate can be of any effective thickness. Typical thicknesses for the substrate are from about 50 to about 500 microns, and preferably from about 100 to about 125 microns, although the thickness can be outside these ranges.

Each substrate 25, 98 is provided with coatings for producing enhanced simulated color photographic-quality prints using xerographic or ink jet imaging. Each substrate is preferably on each side with at least one coating.

The transparent substrate 25 is provided with a coating 99 on each side or surface thereof which coating is comprised of, for example, a hydrophilic polymer such as a latex polymer.

In a first coating 100 applied to one side or surface of a backing sheet 98, an adhesive binder material may be present within the coating in any effective amount; typically the binder or mixture thereof is present in amounts of from about 70 percent by weight to about 90 percent by weight although the amounts can be outside of this range. A Optional antistatic agent, biocide and filler may be included in the first coating. A second coating 102 which is applied to the first coating comprises a hydrophilic polymer material. A third coating 104 which is applied to the non image side of the substrates includes a hydrophobic polymer and a lightfastness inducing compound or mixture, the former being waterfast and highly scuff resistant.

Examples of suitable binder polymers of the first coating 100 include polyesters, such as polyester latexes, including as AQ-29D, available from Eastman Chemicals, poly(4,4-dipropoxy-2,2-diphenyl propane fumarate) #324, available from Scientific Polymer Products, poly(ethylene terephthalate) #138 and #418, available from Scientific Polymer Products, poly(ethylene succinate) #150, available from Scientific Polymer Products, poly(1,4-cyclohexane dimethylene succinate) #148, available from Scientific Polymer Products, or the like; polyvinyl acetate polymers, such as #346, #347, and #024, available from Scientific Polymer Products, or the like; vinylalcohol-vinyl acetate copolymers, such as those with a vinyl acetate content of about 91 percent by weight, including #379, available from Scientific Polymer Products, or the like; polycarbonates, such as #035, available from Scientific Polymer products, or the like; styrene-butadiene copolymers, such as those containing about 85 percent by weight styrene monomers and prepared as disclosed in U.S. Pat. No. 4,558,108, the disclosure of which is totally incorporated herein by reference, styrene-butadiene copolymers containing from about 5 to about 50 percent by weight styrene monomers and available as #199, #200, #201, #451, and #057 from Scientific Polymer Products, and the like; styrene-ethylene-butylene copolymer containing from about 5 to about 50 percent by weight styrene monomers and available as #453 from Scientific Polymer Products, and the like, styrene-isoprene copolymers, such as those with a styrene content of 50 percent by weight or more and prepared via living anionic polymerization techniques as disclosed by S. Malhotra et al. in J. Macromol Science-Chem A(20)7, page 733, the disclosure of which is totally incorporated herein by reference, and the like; styrene-alkyl methacrylate copolymers, wherein alkyl is methyl, ethyl, isopropyl, butyl, hexyl, isodecyl, dodecyl, hexadecyl, octadecyl, or the like, such as those prepared via ultrasonic polymerization as described b S. Malhotra et al. in J. Macromol Science-Chem A18(5), page 783, the disclosure of which is totally incorporated herein by reference, or the like; styrene-aryl methacrylate copolymers, wherein aryl is phenyl, benzyl, or the like, such as those prepared via ultrasonic polymerization as described by S. Malhotra et al. in J. Macromol Science-Chem A18(5), page 783, or the like; styrene-butylmethacrylate copolymers, such as #595, available from Scientific Polymer Products, or the like; styrene-allyl alcohol copolymers, such as #393 and #394, available from Scientific Polymer Products, or the like; styrene-maleic anhydride copolymers, such as those containing from about 50 to about 75 percent by weight styrene monomers, including #456, #049, #457, and #458, available from Scientific Polymer Products, or the like; as well as mixtures thereof.

Further, the first 100 coating of the recording sheets may contain optional antistatic components. Examples of antistatic components include both anionic and cationic materials. Examples of anionic antistatic components include monoester sulfosuccinates, diester sulfosuccinates, and sulfosuccinamates. Examples of cationic antistatic components include diamino alkanes, such as those available from Aldrich Chemicals, quaternary salts, such as Cordex AT-172 and other materials available from Finetex Corp., and the like. Other suitable antistatic agents include quaternary acrylic copolymer latexes, Also suitable as antistatic agents are quaternary choline halides. Additional examples of materials suitable as antistatic components include those disclosed in copending applications Ser. Nos. 08/033,918, 08/034,917 now U.S. Pat. No. 5,457,468 pending filed in the name of Malhotra et al and U.S. Pat. No. 5,314,747, U.S. Pat. No. 5,320,902, and U.S. Pat. No. 5,441,795, the disclosures of each of which are totally incorporated herein by reference.

Further, the first coating of the recording sheets may contain one or more non-ionic, cationic and anionic biocides. The biocide can be present in any effective amount; typically, the biocides is present in an amount of from about 10 parts per million to about 3 percent by weight of the coating, although the amount can be outside this range.

In addition, the first 100 coating of the recording sheets may contain optional filler components. Fillers can be present in any effective amount provided that the substantial transparency of the recording sheet is maintained, and if present, typically are present in amounts of from about 0.5 to about 5.0 percent by weight of the coating composition. Examples of filler components include colloidal silicas, such as Syloid 74, available from Grace Company, titanium dioxide (available as Rutile or Anatase from NL Chem Canada, Inc.), hydrated alumina (Hydrad TMC-HBF, Hydrad TM-HBC available from J. M. Huber Corporation), barium sulfate (K. C. Blanc Fix HD80, available from Kali Chemie Corporation), calcium carbonal (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blends of calcium fluoride and silica, such as Opalex-C available from Kemira O. Y, zinc oxide, such as Zoco Fax 183, available from Zo Chem. blends of zinc sulfide with barium sulfate, such as Lithopane, available from Schteben Company, and the like, microspheres; the microspheres can be either hollow or solid, and have a typical average particle diameter of from about 0.1 to about 50 microns, preferably from about 1 to about 10 microns, although the particle size can be outside these ranges. Example: of hollow microspheres include Eccospheres MC-37 (sodium borosilicate glass), Eccospheres FTD 202 (high silica glass, 95% $S10_2$), and Eccospheres SI (high silica glass, 98% $S10_2$), all available from Emerson and Cuming Inc.; Fillite 200/7 (alumino-silicate ceramic, available from Fillite U.S.A.); Q-Cel 300 (sodium borosilicate, available from Philadelphia Quartz); B23/500 (soda lime glass, available from 3M Company); Ucar BJ0-0930 (phenolic polymers, available from Union Carbide); Miralite 177 (vinylidene chloride-acrylonitrile, available from Pierce & Steven, Chemical Corp.); and the like. Examples of solid microspheres include Spheriglass E250P2 and 10002A (soda-lime glass A-glass, E-glass), available from Potters Industries; Micro-P (soda-lime glass), available from D. J. Enterprises; ceramic micro'spheres (available from Fillite U.S.A. and Zeelan Industries); glass beads 3–10 microns (#07666, available from Polymer Sciences Inc); solid plastic microspheres, available from Rohm & Haas, Dow Chemicals, Diamond Shamrock, and E. I. DuPont de Nemours & Co.; and the like. Mixtures of two or more types of microspheres can also be employed. Further information regarding microspheres is disclosed in, for example, *Encyclopedia of Polymer Science and Engineering*, vol. 9, p. 788 et seq., John Wiley and Sons (New York 1987), the disclosure of which totally incorporated herein by reference as well as mixtures thereof.

The third coating 104 is present on the back side of the substrate 98 in any effective thickness. Typically, the total thickness of the coating layer is from about 0.1 to about 25 micron and preferably from about 0.5 to 10 microns, although the thickness can be outside of these ranges. In the third coating composition, the binder can e present within the coating in any effective amount; typically the binder or mixture thereof are present in amounts of from about 70 percent by weight to about 90 percent by weight although the amounts can be outside of this range. The antistatic agent or mixture thereof are present in the second coating composition, in amounts of from about 0.5 percent by weight to about 20 percent by weight although the amounts can be outside of this range. The lightfastness inducing compounds or mixture thereof are present in the second coating composition, in amounts of from about 0.5 percent by weight to about 20 percent by weight although the amounts can be outside of this range.

The hydrophobic polymers of the third coating composition include poly (vinyl formal), such as #012, available from Scientific Polymer Products, poly (vinyl butyral), such as #043, #511, #507, available from Scientific Polymer Products, vinyl alcohol-vinyl butyral copolymers such as #381, available from Scientific Polymer Products, vinyl alcohol-vinyl acetate copolymers such as #379, available from Scientific Polymer Products, vinyl chloride-vinyl acetate copolymers such as #063, #068, #070, #422 available from Scientific Polymer Products, vinyl chloride-vinyl acetate-vinyl alcohol terpolymers such as #064, #427, #428 available from Scientific Polymer Products, vinyl chloride-vinylidene chloride copolymers such as #058, available from Scientific Polymer Products, vinylidene chloride-acrylonitrile copolymers such as #395, #396, available from Scientific Polymer Products, cyanoethylated cellulose, such as #091, available from Scientific Polymer Products, cellulose acetate hydrogen phthalate, such as #085, available from Scientific Polymer Products, hydroxypropylmethyl cellulose phthalate, such as HPMCP, available from Shin-Etsu Chemical, hydroxypropyl methyl cellulose succinate, such as HPMCS, available from Shin-Etsu Chemical, cellulose triacetate, such as #031, available from Scientific Polymer Products, cellulose acetate butyrate, such as #077, available from Scientific Polymer Products, cellulose propionate such as #2052, available from Scientific Polymer Products, polystyrene such as #039A, #039D, #845, #756 available from Scientific Polymer Products, poly (4-methylstyrene), such as #315, #593, #839, available from Scientific Polymer Products, poly (α-methylstyrene), such as #2055, available from Scientific Polymer Products, poly (tert-butylstyrene), such as #177, available from Scientific Polymer Products, poly (2-chlorostyrene), such as #777, available from Scientific Polymer Products, poly (3-chlorostyrene), such as #778, available from Scientific Polymer Products, poly (4-chlorostyrene), such as #257, available from Scientific Polymer Products, poly (2-bromostyrene), such as #775, available from Scientific Polymer Products, poly (3-bromostyrene), such as #776, available from Scientific Polymer Products, poly (4-bromostyrene), such as #212, available from Scientific Polymer Products. poly (4-methoxy styrene), such as #314, available from Scientific Polymer Products poly (2,4,6-tribromostyrene), such as #166, available from Scientific Polymer Products, styrene-butylmethacrylate copolymers, such as #595, available from Scientific Polymer Products, styrene-acrylonitrile copolymers, such as #495, available from Scientific Polymer Products, styrene-allyl alcohol copolymers, such as #393, #394 available from Scientific Polymer Products, poly(2-vinyl pyridine) such as #813, 814 available from Scientific Polymer Products, poly(4-vinyl pyridine) such as #700, #840 available from Scientific Polymer Products, poly(2-vinyl pyridine-co-styrene) such as #319, available from Scientific Polymer Products, poly(4-vinyl pyridine-co-styrene) such as #416, #859 available from Scientific Polymer Products, poly(4-vinyl pyridine-co-butylmethacrylate) such as #312, #667, #858, available from Scientific Polymer Products, poly(vinyl toluene) such as #261, available from Scientific Polymer Products, poly(2-vinyl naphthalene) such as #163, available from Scientific Polymer Products, poly(methylmethacrylate) such as #037A, #037B, #037D, #307, #424, #689, available from Scientific Polymer Products, poly(ethyl methacrylate) such as #113, #308, available from Scientific Polymer Products, poly(isopropyl methacrylate) such as #476, available from Scientific Polymer Products, poly(phenyl methacrylate) such as #227, available from Scientific Polymer Products, poly(phenoxy ethyl methacrylate) such as #893, available from Scientific Polymer Products, poly(2-hydroxypropyl methacrylate) such as #232, available from Scientific Polymer Product, polyamide resin such as #385, #386, #387, #388, #389, #390, available from Scientific Polymer Products, poly(p-phenylene ether-sulfone) (such as #392, available from Scientific Polymer Products), polysulfones, such as #046, available from Scientific Polymer Products, aromatic ester carbonate copolymers, such as APE KLI-9306, APE KLI-9310, available from Dow Chemical Company, poly carbonates, such as #035, available from Scientific Polymer Products, α-methylstyrene-dimethylsiloxane block copolymers, such as PS 0965, available from Petrarch System, dimethyl siloxane-bisphenol A carbonate block copolymers, such as PSO99, available from Petrarch Systems, poly (2,6-dimethyl p-phenylene oxide), such as #126, available from Scientific Polymer Products.

The lightfastness including agents of the third coating include UV absorbing compounds including 2-(4-benzoyl-3-hydroxyphenoxy)ethylacrylate (Cyasorb UV-416, #41,321-6, available from Aldrich chemical company), 1,2-hydroxy- 4-(octyloxy)benzophenone (Cyasorb UV-531, #41,315-1, available from Aldrich chemical company), poly [2-(4-benzoyl-3-hydroxyphenoxy)ethylacrylate](Cyasorb UV-2126, #41,323-2, available from Aldrich chemical company), hexadecyl 3,5-di-tert-butyl-4-hydroxybenzoate (Cyasorb UV-2908, #41,320-8, available from Aldrich chemical company), poly[N,N-bis(2,2,6,6-tetramethyl-4-piperidinyl)-1,6-hexanediamine-co-2,4--dichloro-6-morpholino-1,3,5-triazine) (Cyaso UV-3346, #41,324-0, available from Aldrich chemical company), 2-dodecyl-N-(2,2,6,6-tetramethyl-4-piperidinyl) succinimide(Cyasorb UV-3581, #41,317-8, available from Aldrich chemical company),2-dodecyl-N-(1,2,2,6,6-pentamethyl-4-piperidinyl) succinimide(Cyasorb UV-3604, #41,318-6, available from Aldrich chemical company), N-(1-acetyl-2,2,6,6-tetramethyl-4-piperidinyl)-2-dodecylsuccinimide (Cyasorb UV-3668, #41,319-4, available from Aldrich chemical company), 1-[N-[poly(3-allyloxy-2-hydroxypropyl)-2-aminoethyl]-2-imidazolidinone (#41,026-8, available from Aldrich chemical company), poly(2-ethyl-2-oxazoline)(#37,284-6, #37,285-4, #37,397-4, available from Aldrich chemical company). The lightfastness inducing agents of the second coating composition of the present invention include antioxidant and antiozonant compounds such as 2,2'-methylenebis(6-tert-butyl-4-methylphenol)(Cyanox 2246, #41,315-5, available from Aldrich chemical company), 2,2'-methylenebis(6-tert-butyl-4-ethylphenol)(Cyanox 425, #41,314-3, available from Aldrich chemical company), Tris(4-tert-butyl-3-hydroxy-2,6-dimethylbenzyl)isocyanurate (Cyanox 1790, #41,322-4, LTDP, #D12,840-6, available from Aldrich chemical company),didodecyl 3,3'-thiodipropionate (Cyanox, LTDP, #D12,840-6, available from Aldrich chemical company), ditridecyl 3,3'-thiodipropionate (Cyanox 711, #41,311-9, available from Aldrich chemical company),ditetradecyl 3,3'-thiodipropionate (Cyanox, MTDP, #41,312-7, available from Aldrich chemical company),ditoctadecyl 3,3'-thiodipropionate (Cyanox, STDP, #41,310-0, available from Aldrich chemical company),1,3,5-trimethyl-2,4,6-tris (3,5-di-tert-butyl-4-hydroxybenzyl)benzene(Ethanox 300, #41,328-3, available from Aldrich chemical company),2,6-ditert-butyl-4-(dimethylaminomethyl)phenol (Ethanox 703, #41,327-5, available from Aldrich chemical company).

The coating composition of the present invention can be applied to the substrate by any suitable technique. For example, the layer coatings can be applied by a number of known techniques, including melt extrusion, reverse roll coating, solvent extrusion, dip coating processes. In dip coating, a web of material to be coated is transported below the surface of the coating material (which generally is dissolved in solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. Once the desired amount of coating has been applied to the web, the coating is dried, typically at from about 25° to about 100° C. in an air drier.

Recording sheets of he present invention can be employed in printing and copying processes wherein dry of liquid electrophotographic-type developers are employed, such as electrophotographic processes, ionographic processes, or the like.

In a particularly preferred embodiment, the present invention is directed to generating a reverse reading electrostatic latent image on an imaging member in an imaging apparatus, developing the latent image with a toner and transferring the developed image 67 to a recording sheet 25; generating a direct reading electrostatic latent image on an imaging member in an imaging apparatus developing the latent image with a toner and transferring the developed image *67a* to a recording or backing sheet 98; laminating the reverse and the direct reading imaged recording sheets with heat and pressure to generate a laminated transparent recording sheet of higher optical density. It is preferred that the toner resin be a polymer containing the same monomers as the binder polymer of the recording sheet. As noted hereinbefore, the image *67a* contains the exact information as the image 67 but it is reverse reading such that when the two images are superimposed they form a single right reading image, as viewed through the non-imaged side of the transparent substrate 25. The result of such an arrangement is the formation of a simulated photographic-quality color print which exhibits a very high optical density.

Examples of suitable toner resins for the process of the present invention include polyesters, such as polyester latexes, including as AQ-29D, available from Eastman Chemicals, poly(4,4-dipropoxy-2,2-diphenyl propane fumarate) #324, available from Scientific Polymer Products, poly(ethylene terephthalate) #138 and #418, available from Scientific Polymer Products, poly(ethylene succinate) #151, available from Scientific Polymer Products, poly(1,4-cyclohexane dimethylene succinate) #148, available from Scientific Polymer Products, or the like; polyvinyl acetate polymers, such as #346, #347, and #024, available from Scientific Polymer Products, or the like; vinylalcohol-vinyl acetate copolymers, such as those with a vinyl acetate content of about 91 percent by weight, including #379, available from Scientific Polymer Products, or the like; polycarbonates, such as #035, available from Scientific Polymer products, or the like; and the like, styrene-butadiene copolymers, such as those containing about 85 percent by weight styrene monomers and prepared as disclosed in U.S. Pat. No. 4,558,108, the disclosure of which is totally incorporated herein by reference, styrene-butadiene copolymers containing from about 5 to about 50 percent by weight styrene monomers and available as #199, #200, #201, #451, and #057 from Scientific Polymer Products, and the like; styrene-ethylene-butylene copolymer containing from about 5 to about 50 percent by weight styrene monomers and available as #453 from Scientific Polymer Products, and the like; styrene-isoprene copolymers, such as those with a styrene content of 50 percent by weight or more and prepared via living anionic polymerization techniques as disclosed by S. Maihotra et al. in J. Macromol Science-Chem. A(20)7, page 733, the disclosure of which is totally incorporated herein by reference, and the like; styrene-alkyl methacrylate copolymers, wherein alkyl is methyl, ethyl, isopropyl, butyl, hexyl, isodecyl, dodecyl, hexadecyl, octadecyl, or the like, such as those prepared via ultrasonic polymerization as described by S. Malhotra et al. in J. Macromol Science-Chem. A18(5), page 783, the disclosure of which is totally incorporated herein by reference, or the like; styrene-aryl methacrylate copolymers, wherein aryl is phenyl, benzyl, or the like, such as those prepared via ultrasonic polymerization as described by S. Malhotra et al. in J. Macromol Science-Chem. A18(5), page 783, or the like; styrene-butylmethacrylate copolymers, such as #595, available from Scientific Polymer Products, or the like; styrene-allyl alcohol copolymers, such as #393 and #394, available from Scientific Polymer Products, or the like; styrene-maleic anhydride copolymers, such as those containing from about 50 to about 75 percent by weight styrene monomers, including #456, #049, #457 and #458, available from Scientific Polymer Products, or the like; as well as mixtures thereof as well as mixtures thereof. In a preferred embodiment, the toner resin contains the same monomers present in the polymeric binder of the recording sheet. The resin is present in the toner in any effective amount, typically from about 10 to 95 percent by weight, preferably from about 20 to about 90 percent by weight, and more preferably from about 50 to about 70 percent by weight, although the amount can be outside these ranges.

Images that are visible with the naked eye contain a colorant. Typically, the colorant material is a pigment, although dyes can also be employed. Examples of suitable pigments and dyes are disclosed in, for example, U.S. Pat. No. 4,788,123, U.S. Pat. No. 4,828,956, U.S. Pat. No. 4,894,308, U.S. Pat. No. 4,948,686, U.S. Pat. No. 4,963,455, and U.S. Pat. No. 4,965,158, the disclosures of each of which are totally incorporated herein by reference. Specific examples of suitable dyes and pigments include carbon black, nigrosine dye, aniline blue, magnetites, and mixtures thereof, with carbon black being the most common colorant. The pigment should be present in an amount sufficient to render the toner composition highly colored to permit the formation of a clearly visible image on a recording member. Typically, the pigment particles are present in amounts of from about 1 percent by weight to about 20 percent by weight based on the total weight of the toner composition, although the amount can be outside this range.

When the pigment particles are magnetites, which comprise a mixture of iron oxides ($Fe_3O_4$) such as those commercially available as Mapico Black, these pigments are present in the toner composition in any effective amount, typically from about 10 percent by weight to about 70 percent by weight, and preferably from about 20 percent by weight to about 50 percent by weight, although the amount can be outside these ranges.

Colored toner pigments are also suitable, including red, green, blue, brown, magenta, cyan, and yellow particles, as well as mixtures thereof, wherein the colored pigments are present in amounts that enable the desired color. Illustrative examples of suitable magenta pigments include 2,9-dimethyl-substituted quinacridone and anthraquinone dye, identified in the color index as CI 60710, CI Dispersed Red 15, a diazo dye identified in the color index as CI 26050, CI Solvent Red 19, and the like. Illustrative examples of suitable cyan pigments include copper tetra-4-(octadecyl sulfonamido) phthalocyanine, copper phthalocyanine pigment, listed in the color index as CI 74160, Pigment Blue, and Anthradanthrene Blue, identified in the color index as CI 69810, Special Blue X-2137, and the like. Illustrative examples of yellow pigments that may be selected include diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Other suitable toner colorants include Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Heliogen Blue L6900, L7020 (BASF), Heliogen Blue D6840, D7080 (BASF), Sudan Blue OS (BASF), PV Fast Blue B2G01 (American Hoechst), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FG1 (Hoechst), Permanent Yellow YE 0305 (Paul Uhlich), Lumogen Yellow D0790 (BASF), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Tolidine Red (Aldrich), Scarlet for Thermoplast NSD P PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF). Color pigments are typically present in the toner an amount of from about 15 to about 20.5 percent by weight, although the amount can be outside this range.

The toner compositions of the present invention can also contain an optional charge control additive. Examples of suitable charge control agents are disclosed in U.S. Pat. No. 4,788,123, U.S. Pat. No. 4,828,956, U.S. Pat. No. 4,894,308, U.S. Pat. No. 4,948,686, U.S. Pat. No. 4,963,455, and U.S. Pat. No. 4,965,158, the disclosures of each of which are totally incorporated herein by reference. Specific examples of suitable charge control agents include alkyl pyridinium halides, such as cetyl pyridinium chloride, as disclosed in U.S. Pat. No. 4,298,672, the disclosure of which is totally incorporated herein by reference, cetyl pyridinium tetrafluoroborates, quaternary ammonium sulfate and sulfonate compounds, such as distearyl dimethyl ammonium methyl sulfate, as disclosed in U.S. Pat. No. 4,338,390, the disclosure of which is totally incorporated herein by reference, stearyl phenethyl dimethyl ammonium tosylates, as disclosed in U.S. Pat. No. 4,338,390, distearyl dimethyl ammonium methyl sulfate, as disclosed in U.S. Pat. No. 4,560,635, the disclosure of which is totally incorporated herein by reference, distearyl dimethyl ammonium bisulfate as disclosed in U.S. Pat. No. 4,937,157 and U.S. Pat. No. 4,560,635, the disclosures of each of which are totally incorporated herein by reference, stearyl dimethyl hydrogen ammonium tosylate, charge control agents as disclosed in U.S. Pat. No. 4,294,904, the disclosure of which is totally incorporated herein by reference, zinc 3,5-di-tert-butyl salicylate compounds, such as Bontron E-84, available from Orient Chemical Company of Japan, or zinc compounds as disclosed in U.S. Pat. No. 4,656,112, the disclosure of which is totally incorporated herein by reference, aluminum 3,5-di-tert-butyl salicylate compounds, such as Bontron E-88, available from Orient Chemical Company of Japan, or aluminum compounds as disclosed in U.S. Pat. No. 4,845,003, the disclosure of which is totally incorporated herein by reference, and the like, as well as mixtures thereof and/or any other charge control agent suitable for dry electrophotographic toners. Additional examples of suitable charge control additives are disclosed in U.S. Pat. No. 4,560,635 and U.S. Pat. No. 4,294,904, the disclosures of each of which are totally incorporated herein by reference. Charge control agents are present in any effective amount, typically from about 0.1 to about 4 percent by weight, and more preferably from about 0.5 to about 1 percent by weight, although the amount can be outside this range.

The toner compositions can be prepared by any suitable method. For example, the components of the dry toner particles can be mixed in a ball mill, to which steel beads for agitation are added in an amount of approximately five times the weight of the toner. The ball mill can be operated at about 120 feet per minute for about 30 minutes, after which time the steel beads are removed. Dry toner particles for two-component developers generally have an average particle size of from about 6 to about 20 microns.

Another method, known as spray drying, entails dissolving the appropriate polymer or resin in an organic solvent such as toluene or chloroform, or a suitable solvent mixture. The toner colorant is also added to the solvent. Vigorous agitation, such as that obtained by ball milling processes, assists in assuring good dispersion of the colorant. The solution is then pumped through an atomizing nozzle while using an inert gas, such as nitrogen, as the atomizing agent. The solvent evaporates during atomization, resulting in toner particles of a colored resin, which are the attrited and classified by particle size. Particle diameter of the resulting toner varies, depending on the size of the nozzle, and generally varies between about 0.1 and about 100 microns.

Another suitable process is known as the Banbury method, a batch process wherein the dry toner ingredients are pre-blended and added to a Banbury mixer and mixed, at which point melting of the materials occurs from the heat energy generated by the nixing process. The mixture is then dropped into heated rollers and forced through a nip, which results in further shear mixing to form a large thin sheet of the toner material. This material is then reduced to pellet form and further reduced in size by grinding or jetting, after which the particles are classified by size.

Another suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size.

Other similar blending methods may also be used. Subsequent to size classification of the toner particles, any external additives are blended with the toner particles. If desired, the resulting toner composition is then mixed with carrier particles.

Any suitable external additives can also be utilized with the dry toner particles. The amounts of external additives are measured in terms of percentage by weight of the toner composition, but are not themselves included when calculating the percentage composition of the toner. For example, a toner composition containing a resin a colorant, and an external additive can comprise 80 percent by weight resin and 20 percent by weight colorant; the amount of external additive present is reported in terms of its percent by weight of the combined resin and colorant. Eternal additives can include any additives suitable for use in electrostatographic toners, including straight silica, colloidal silica (e.g. Aerosil R972, available from Degussa, Inc.), ferric oxide, Unilin (a linear polymeric alcohol comprising a fully saturated hydrocarbon backbone with at least about 80 percent of the polymeric chains terminated at one chain end with a hydroxyl group, of the general formula $CH_3(CH_2)_nCH_2OH$, wherein n is a number from about 30 to about 300, and preferably from about 30 to about 50, available from Petrolite Chemical Company), polyethylene waxes, polypropylene waxes, polymethylmethacrylate, zinc stearate, chromium oxide, aluminum oxide, stearic acid, polyvinylidene fluoride (e.g. Kynar®, available from Pennwalt Chemicals Corporation), and the like. External additives can be present in any desired or effective amount.

Dry toners can be employed alone in single component development processes, or they can be employed in combination with carrier particles in two component development processes. Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process.

Carrier particles can possess coated surfaces. Typical coating materials include polymers and terpolymers, including, for example, fluoropolymers such as polyvinylidene fluorides as disclosed in U.S. Pat. No. 3,526,533, U.S. Pat. No. 3,849,186, and U.S. Pat. No. 3,942,979, the disclosures of each of which are totally incorporated herein by reference. Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved. Carrier coatings may be of any desired thickness or coating weight. Typically, the carrier coating is present in an amount of from about 0.1 to about 1 percent by weight of the uncoated carrier particle, although the coating weight may be outside this range.

The toner is present in the two-component developer in any effective amount, typically from about 1 to about 5 percent by weight of the carrier, and preferably about 3 percent by weight of the carrier, although the amount can be outside these ranges.

Any suitable conventional electrophotographic development technique can be utilized to deposit toner particles of the present invention on an electrostatic latent image on an imaging member. Well known electrophotographic development techniques include magnetic brush development, cascade development, powder cloud development, electrophoretic development, and the like. Magnetic brush development is more fully described, for example, in U.S. Pat. No. 2,791,949, the disclosure of which is totally incorporated herein by reference; cascade development is more fully described, for example, in U.S. Pat. No. 2,618,551 and U.S. Pat. No. 2,618,552, the disclosures of each of which are totally corporated herein by reference; powder cloud development is more fully described, for example, in U.S. Pat. No. 2,725,305, U.S. Pat. No. 2,918,910, and U.S. Pat. No. 3,015,305, the disclosures of each of which are totally incorporated herein reference; and liquid development is more fully described, for example, in U.S. Pat. No. 3,084,043, the disclosure of which is totally incorporated herein by reference.

The deposited tone image can be transferred to the recording sheet by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5000 and about 8000 volts provides satisfactory electrostatic charge for transfer.

After transfer, the transferred toner image can be fixed to the recording sheet. The fixing step can be also identical to that conventionally used in electrophotographic imaging. Typical, well known electrophotographic fusing techniques include heated roll fusing, flash fusing, oven fusing, laminating, adhesive spray fixing, and the like. The fusing of toner on certain transparencies that do not contain the additives of the present invention leads to uneven distribution of the toner on the surface of the transparency due to inadequate wetting of the surface by the toner. This leads to the formation of dark and light patches of toner (islands) that are not pleasant to the eye when viewed on a light projector. These islands are difficult to quantify by conventional methods,but their presence or absence can be seen visually. In the context of the present invention the results on the presence of these defects in the form of islands is presented as unacceptable and the absence of these islands is presented as acceptable qualitatively.

The recording sheet of the present invention can also be used in any other printing or imaging process, such as printing with pen plotters, handwriting with ink pens, offset printing processes, or the like, provided that the ink employed to form the image is compatible with the ink receiving layer of the recording sheet.

The optical density measurements recited herein were obtained on a Pacific Spectrograph Color System. The system consists of two major components, an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nanometers. The data terminal features a 12 inch CRT display, numerical keyboard for selection of operating parameters and the entry of tristimulus values, and an alphanumeric keyboard for entry of product standard information.

Specific examples relating to the invention will now be described in detail. These examples are intended to be illustrative, and the invention is not limited to the materials, conditions, or process parameters set forth in these embodiments. All parts and percentages are by weight unless otherwise indicated.

EXAMPLE I

Twenty coated recording sheets were prepared by the solvent extrusion process (single side each time initially) on a Faustel Coater using a one slot die, by providing for each MYLAR base sheet (roll form) with a thickness of 100 microns and coating the base sheet with a toner receiving composition comprised of 90 percent by weight polyester latex Eastman AQ 29D available from Eastman Chemical Company; 6.0 percent by weight of the antistatic agent commercially available from Alkaril Chemicals as, Alkasurf SS-L7DE, 3.0 percent by weight of microspheres Miralite 177 (vinylidene chloride-acrylonitrile, available from Pierce & Stevens Chemical Corp.); 1.0 percent by weight of non-ionic biocide, such as 2-hydroxypropylmethane thiosulfonate (Busan 1005, available from Buckman Laboratories Inc.) which composition was present in a concentration of 35 percent by weight in water. Subsequent to air drying at 100° C. and monitoring the difference in weight prior to and subsequent to coating, the dried Mylar base sheet rolls were coated with 1 gram, 10 microns in thickness, of polyester adhesive. Rewinding the coated side of the MYLAR on to an empty core and using these rolls, the uncoated sides of the MYLAR were coated in each instance (20 sheets) with a hydrophobic blend comprised of 90 percent by weight of hydroxypropylmethyl cellulose phthalate, such as HPMCP, available from Shin-Etsu Chemical; 5 percent by weight of the antistat polymethyl acrylate trimethyl ammonium chloride latex, such as HX42-1, available from Interpolymer Corp; 3 percent by weight of UV absorbing compound 2-(4-benzoyl-3hydroxyphenoxy) ethylacrylate (Cyasorb UV-416, #41,321-6, available from Aldrich chemical company) and 2 percent by weight of an antioxidant compound didodecyl 3,3'-thiodipropionate (Cyanox, LTDP, #D12,840-6, available from Aldrich chemical company), present in a concentration of 5 percent by weight in acetone. Subsequent to air dying at 100° C. and monitoring the difference in weight prior to and subsequent to coating, the dried MYLAR rolls were coated with 0.5 gram, 5 microns in thickness, of the scuff resistant, lightfast, waterfast and high gloss coating of hydroxypropylmethyl cellulose phthalate containing polymethyl acrylate trimethyl ammonium chloride latex, 2-(4-benzoyl-3hydroxyphenoxy) ethylacrylate and didodecyl 3,3'-thiodipropionate. The coated recording sheets were cut frown this roll into 8.5× 11.0 inch cut sheets. These substrates or sheets were utilized in a Xerox 5760 MajestiK Digital Color Copier carrying polyester resin based toners and images were obtained on the toner receiving side of the recording sheet. These images had optical density values of 1.37 (cyan), 1.23 (magenta), 0.87 (yellow) and 1.54 (black). These images were waterfast when washed with water for 2 minutes at 50° C. and lighast for a period of three months without any change in their optical density.

EXAMPLE II

Twenty coated recording sheets were prepared by the solvent extrusion process (single side each time initially) on a Faustel Coater using a one slot die, by providing each Mylar base sheet (roll form) with a thickness of 100 microns and coating the base sheet with a toner receiving composition comprised of 90 percent by weight vinylalcohol-vinyl acetate copolymers, such as those with a vinyl acetate content of about 91 percent by weight, including #379, available from Scientific Polymer Products; 6.0 percent by weight of the antistatic agent quaternary salts, such as Cordex AT-172 available from Finetex Corp.; 3.0 percent by weight of microspheres Eccospheres MC-37 (sodium borosilicate glass), available from Emerson and Cuming Inc; 1.0 percent by weight of non-ionic biocide, such as 2-bromo-4'-hydroxyacetophenone (Busan 90, available from Buckman Laboratories); which composition was present in a concentration of 10 percent by weight in acetone. Subsequent to air drying at 100° C. and monitoring the difference in weight prior to and subsequent to coating, the dried Mylar base sheet rolls were coated with 1 gram, 10 microns in thickness, of vinylalcohol-vinyl acetate copolymer adhesive. Rewinding the coated side of the MYLAR on to an empty core and using these rolls, the uncoated sides of the MYLAR were coated in each instance (20 sheets) with a hydrophobic blend comprised of 90 percent by weight of aromatic ester carbonate copolymer, such as APE KLI-9306, available from Dow Chemical Company; 5 percent by weight of the antistat (4-ethoxybenzyl) triphenyl phosphonium bromide (Aldrich 26,648-5); 3 percent by weight of UV absorbing compound poly[N,N-bis(2,2,6,6-tetramethyl-4-piperidinyl)-1,6-hexanediamine-co-2,4-dichloro-6-morpholino-1,3,5-triazine) (Cyasorb UV-3346, #41,324-0, available from Aldrich chemical company) and 2 percent by weight of an antioxidant compound 2,6-ditert-butyl-4-(dimethylaminomethyl)phenol (Ethanox 703, #41,327-5, available from Aldrich chemical company), present in concentration of 5 percent by weight in acetone. Subsequent to air drying at 100° C. and monitoring the difference in weight prior to and subsequent to coating, the dried MYLAR rolls were coated with 0.5 gram, 5 microns in thickness, of the scuff resistant, lightfast, waterfast and high gloss coating of aromatic ester carbonate copolymer containing (4-ethoxybenzyl) triphenyl phosphonium bromide, poly[N,N-bis(2,2,6,6-tetramethyl-4-piperidinyl)-1,6-hexanediamine-co-2,4-dichloro-6-morpholino-1,3,5-triazine) and 2,6-ditert-butyl-4-(dimethylaminomethyl) phenol. The coated recording sheets were cut from this roll into 8.5×11.0 inch cut sheets. These recording substrates or sheets were utilized in a Xerox 5760 MajestiK Digital Color Copier carrying vinylalcohol-vinyl acetate copolymer resin based toners and images were obtained on the toner receiving side of the recording sheet. These images had optical density values of 1.30 (cyan), 1.25 (magenta), 0.85 (yellow) and 1.64 (black). These images were waterfast when washed with water for 2 minutes at 50° C. and lightfast for a period of three months without any change in their optical density.

EXAMPLE III

Twenty coated recording sheets were prepared by the solvent extrusion process (single side each time initially) on a Faustel Coater using a one slot die, by providing for each a Mylar base sheet (roll form) with a thickness of 100 microns and coating the base sheet with a toner receiving composition comprised of 90 percent by weight, styrene-butadiene copolymers, such as those containing about 85 percent by weight styrene monomers and prepared as disclosed in U.S. Pat. No. 4,558,108, the disclosure of which is totally incorporated herein by reference; 6.0 percent it by weight of the antistatic agent quaternary salt, acetyl choline chloride $CH_3COOCH_2CH_2N(CH_3)3Cl$ (Aldrich 13,535-6); 3.0 percent by weight of microspheres Eccospheres MC-37 (sodium borosilicate glass), available from Emerson and Cuming Inc; 1.0 percent by weight of non-ionic biocide, such as a non-ionic blend of methylene bis(thiocyanate) 50 percent by weight and 2-(thiocyanomethylthio) benzothiazole 50 percent by weight (available as BUSAN 1009, 1009WB from Buckman Laboratories Inc.), which composition was present in a concentration of 10 percent by weight in toluene. Subsequent to air drying at 100° C. and monitoring the difference in weight prior to and subsequent to coating, the dried Mylar base sheet rolls were coated with 1 gram, 10 microns in thickness, of styrene-butadiene adhesive. Rewinding the coated side of the MYLAR on to an empty core and using these rolls, the uncoated side of the MYLAR were coated in each instance (20 sheets) with a hydrophobic blend comprised of 90 percent by weight of poly (α-methylstyrene); 5 percent by weight of the antistat 2-methyl-3-propyl benzothiazolium iodide Aldrich 36,329-4); 3 percent by weight of UV absorbing compound poly [2-(4-benzoyl-3-hydroxyphenoxy)ethylacrylate](Cyasorb UV-2126, #41,323-2, available from Aldrich chemical company), and 2 percent by weight of an antioxidant compound 2,6-ditert-butyl-4-(dimethylaminomethyl)phenol (Ethanox 703, #41,327-5, available from Aldrich chemical company), present in a concentration of 5 percent by weight in acetone. Subsequent to air drying at 100° C. and monitoring the difference in weight prior to and subsequent to coating, the dried MYLAR rolls were coated with 0.5 gram, 5 microns in thickness, of the scuff resistant, lightfast, waterfast and high gloss coating of poly (α-methylstyrene) containing 2-methyl-3-propyl benzothiazolium iodide, poly [2-(4-benzoyl-3-hydroxyphenoxy)ethylacrylate] and, 2,6-ditert-butyl-4-(dimethylaminomethyl)phenol. The coated recording sheets were cut from this roll in 8.5×11.0 inch cut sheets. These recording sheets were fed in to a Xerox 5760 MajestiK Digital Color Copier carrying styrene-butadiene resin based toners and images were obtained on the toner receiving side of the recording sheet. These images had optical density values of 1.40 (cyan), 1.35 (magenta), 0.85 (yellow) and 1.70 (black). These images were waterfast when washed with water for 2 minutes at 50° C. and lightfast for a period of three months without any change in their optical density.

EXAMPLE IV

Twenty recording sheets coated with polyester adhesive on the image receiving side were prepared as described in EXAMPLE I. Ten of these recording sheets were printed with wrong reading images on their image receiving side using a Xerox 5760 MajestiK Digital Color Copier carrying polyester resin based toners. These images had optical density values of 1.37 (cyan), 1.23 (magenta), 0.87, (yellow) and 1.54 (black) Ten other recording sheets were printed with the right reading images on their image receiving side using a Xerox 5760 MajestiK Digital Color Copier carrying polyester resin based toners. These images had optical density values of 1.37 (cyan), 1.23 (magenta), 0.87 (yellow) and 1.54 (black). Each of the substrates with a wrong reading image thereon was laminated to one of the a right reading image thereon at a temperature of 140° C. and a pressure of 100 psi for 2 minutes in a Model 7000 Laminator from Southwest Binding Systems, Ontario, Canada. The laminated structures exhibited no curl, a gloss of 140 units, no susceptibility to scuffing and enhanced optical density values of 2.55 (cyan), 2.33 (magenta), 1.70 (yellow) and 2.98 (black).

EXAMPLE V

Twenty recording sheets coated with vinylalcohol-vinyl acetate copolymer adhesive on the image receiving side were prepared as described in EXAMPLE II. Ten of these recording sheets were printed with wrong reading images on their image receiving side using a Xerox 5760 MajestiK Digital Color Copier carrying vinylalcohol-vinyl acetate copolymer resin based toners. These images had optical density value of 1.30 (cyan), 1.25 (magenta), 0.85, (yellow) and 1.64 (black). Ten other recording sheets were printed with the right reading images on their image receiving side using a Xerox 5760 MajestiK Digital Color Copier carrying vinylalcohol-vinyl acetate copolymer resin based toners. These images had optical density value of 1.30 (cyan), 1.25 (magenta), 0.85 (yellow) and 1.64 (black). Each of the substrates with a wrong reading image thereon was laminated to one of the substrates with a right reading image thereon at a temperature of 140° C. and a pressure of 100 psi for 2 minutes in a Model 7000 Laminator from Southwest Binding Systems, Ontario, Canada. The laminated structures exhibited no curl, a gloss of 145 units, no susceptibility to scuffing and enhanced optical density values of 2.45 (cyan), 2.30 (magenta), 1.60 (yellow) and 2.88 (black).

EXAMPLE VI

Twenty recording sheets coated with styrene-butadiene adhesive on the image receiving side were prepared as described in EXAMPLE III. Ten of these recording sheets were printed with wrong reading images on their image receiving side using a Xerox 5760 MajestiK Digital Color Copier carrying styrene-butadiene resin based toners. These images had optical density values of 1.40 (cyan), 1.35 (magenta), 0.85, (yellow) and 1.70 (black). Ten other recording sheets were printed with the right reading images on their image receiving side using a Xerox 5760 MajestiK Digital Color Copier carrying styrene-butadiene resin based toners. These images had optical density values of 1.40 (cyan), 1.35 (magenta), 0.85 (yellow) and 1.70 (black). Each of the substrates with a wrong reading image thereon was laminated to one of the substrates with a right reading image thereon at a temperature of 140° C. and a pressure of 100 psi for 2 minutes in a Model 7000 Laminator from Southwest Binding Systems, Ontario, Canada. The laminated structures exhibited no curl, a gloss of 150 units, no susceptibility to scuffing and enhanced optical density values of 2.65 (cyan), 2.50 (magenta), 1.60 (yellow) and 2.99 (black).

Other embodiments and modifications of the present invention may occur to those skilled in the art subsequent to a review of the information presented herein; these embodiments and modifications, as well as equivalents thereof, are also included within the scope of this invention.

What is claimed is:

1. A method of creating simulated photographic-quality prints using non-photographic imaging, including the steps of:

providing a coated transparent substrate having a wrong reading formed thereon using a non-photographic imaging process;

providing a coated substrate having a right reading image formed thereon using a non-photographic imaging process, said right reading image containing the same information as the wrong reading image; and adhering said substrates to each other at a temperature of about 140° C. and a pressure of about 100 psi with said wrong and right reading images in a superimposed relationship.

2. The method according to claim 1 wherein said steps of providing substrates comprises providing substrates with xerographically formed images thereon.

3. The method according to claim 2 wherein said steps of providing substrates comprises providing substrates which prior to having images formed thereon include:

a coating on one side thereof containing (1) a binder selected from the group consisting of (A) polyesters; (B) polyvinyl acetals; (C) vinyl alcohol-vinyl acetal copolymers; (D) polycarbonates; (E) styrene-alkyl alkyl acrylate copolymers and styrene-aryl alkyl acrylate copolymers; (F) styrene-diene copolymers; (G) styrene-maleic anhydride copolymers; (H) styrene-allyl alcohol copolymers; and mixtures thereof; (2) an antistatic agent; (3) a filler; and (4) a biocide; and another coating on another side of said substrates comprised of a hydrophobic abrasion resistant polymeric binder, an antistatic agent, a light fastness inducing agent and a filler.

4. The method according to claim 3 including the step of applying a polyester adhesive to said on one side.

5. The method according to claim 4 wherein said xerographically formed images are formed using a toner resin material comprising a colorant and a resin selected from the group consisting of (A) polyesters; (B) polyvinyl acetals; (C) vinyl alcohol-vinyl acetal copolymers; (D) polycarbonates; (E) styrene-alkyl alkyl acrylate copolymers and styrene-aryl alkyl acrylate copolymers; (F)styrene-diene copolymers; (G) styrene-maleic anhydride copolymers; (H) styrene-allyl alcohol copolymers; and mixtures thereof.

6. The method according to claim 5 wherein said transparent substrate is selected from the group consisting of (1) polyesters, (2) polyethylene naphthalates, (3) polycarbonates, (4)polysulfones, (5) polyether sulfones, (6) poly (arylene sulfones), (7) cellulose triacetate, (8) polyvinylchloride, (9) cellophane, (10)polyvinyl fluoride, (11)polypropylene and (12) polyimides.

7. The method according to claim 5 wherein the thickness of said first coating in contact with said substrates is from about 0.1 to about 25 microns.

8. The method according to claim 7 wherein said binder is selected from the group consisting of (1) polyester latexes, (2) poly(4,4-dipropoxy-2,2-diphenyl propane fumarate), (3) poly(ethylene terephthalate), (4) poly(ethylene succinate), (5) (5) poly(1,4-cyclohexane dimethylene succinate), (6) polycarbonates, polyvinyl acetate, (7) vinylalcohol-vinyl acetate copolymers, (8) styrene-butadiene copolymers, (9) styrene-ethylene-butylene hydrogenated copolymer, (10) styrene-isoprene copolymers, (11) styrene-alkyl methacrylate copolymers, wherein alkyl is methyl, ethyl, isopropyl, butyl, hexyl, isodecyl, dodecyl, hexadecyl, octadecyl; styrene-aryl methacrylate copolymers, wherein aryl is phenyl, benzyl; styrene-allyl alcohol copolymers, styrene-maleic anhydride copolymers, and mixtures thereof.

9. The method according to claim 5 wherein said toner resin material contains the same monomers contained in said binder on said substrates.

10. The method according to claim 9 wherein the antistatic agent is selected from the group consisting of (1) choline halides; (2) acetyl choline halides; (3) acetyl-?-methyl choline halides; (4) benzoyl choline halides; (5) carbamyl choline halides; (6) carnitinamide hydrohalides; (7) carnitine hydrohalides; (8) (2-bromo ethyl) trimethyl ammonium halides; (9) (2-chloro ethyl) trimethyl ammonium halides; (10) (3-carboxy propyl) trimethyl ammonium halides; (11) butyryl choline halides; (12) butyryl thiocholine halides; (13) S-propionyl thiocholine halides; (14) S-acetylthiocholine halides; (15) suberyl dicholine dihalides; and mixtures thereof.

11. The method according to claim 9 wherein said hydrophobic abrasion resistant polymeric binders comprise solvent soluble polymers selected from the group consisting of (1) poly (vinyl formal), (2) poly (vinyl butyral), (3) vinyl alcohol-vinyl butyral copolymers, (4) vinyl alcohol-vinyl acetate copolymers, (5) vinyl chloride-vinyl acetate copolymers, (6) vinyl chloride-vinyl acetate-vinyl alcohol terpolymers, (7) vinyl chloride-vinylidene chloride copolymers, (8) vinylidene chloride-acrylonitrile copolymers, (9) cyanoethylated cellulose (10) celluloseacetatehydrogenphthalate, (11) hydroxypropylmethylcellulosephthalate, (12) hydroxypropylmethylcellulosesuccinate,(13) cellulose triacetate (14) celluloseacetatebutyrate, (15) celluloseproponate, (16) polystyrene, (17) poly(4-methylstyrene), (18)poly (a-methylstyrene), (19) poly (tert-butylstyrene), (20) poly (2-chlorostyrene), (21) poly (3-chlorostyrene), (22) poly(4-chlorostyrene), (23)poly (2-bromostyrene), (24) poly (3-bromostyrene), (25) poly (4-bromostyrene), (26) poly (4-methoxy styrene), (27) poly (2,4,6-tribromostyrene), (28) styrene-butylmethacrylate copolymers, (29) styrene-allyl alcohol copolymers, (30) poly(2-vinyl pyridine) (31) poly (4-vinyl pyridine), (32) poly(2-vinyl pyridine-co-styrene), (33) poly(4-vinyl pyridine-co-styrene), (34), poly(4-vinyl (pyridine-co-butylmethacrylate), (35) poly(vinyl toluene), (36) poly(2-vinyl naphthalene), (37) poly (methylmethacrylate), (38) poly(ethyl methacrylate), (39) poly(isopropyl methacrylate), (40) poly(phenyl methacrylate), (41) poly(phenoxy ethyl methacrylate), (42) poly(2-hydroxypropyl methacrylate), (43) polyamide resin, (44) poly (p-phenylene ether-sulfone), (45) polysulfones, (46) aromatic ester carbonate copolymers, (47) polycarbonates (48) a-methylstyrene-dimethylsiloxane block copolymers, (49) dimethyl siloxane-bisphenol A carbonate block copolymers, (50) poly (2,6-dimethyl p-phenylene oxide); and mixtures thereof.

12. The method according to claim 4 wherein said light fastness inducing agent comprises a UV absorber.

13. The method according to claim 12 wherein said light fastness inducing agent is selected from the group consisting of (1) 2-(4-benzoyl-3-hydroxyphenoxy)ethylacrylate), (2) 1,2-hydroxy-4-(octyloxy)benzophenone, (3) poly[2-(4-benzoyl-3-hydroxypenoxy)ethylacrylate], (4) hexadecyl 3,5-di-tert-butyl-4-hydroxy-benzoat, (5) poly[N,N-bis(2,2,6,6-tetramethyl-4-piperidinyl)-1,6-hexanediamine-co-2,4-dichloro-6-morpholino-1,3,5-triazine), (6) 2-dodecyl-N-(2,2,6,6-tetramethyl-4-piperidinyl) succinimide, (7) 2-dodecyl-N-(1,2,2,6,6-pentamethyl-4-piperidinyl) succinimide, N-(1-acetyl-2,2,6,6-tetramethyl-4-piperidinyl)-2-dodecylsuccinimide, (8) 1-[N-[poly(3-allyloxy-2-hydroxypropyl)-2-aminoethyl]-2-imidazolidinone, (9) poly (2-ethyl-2-oxazoline); and mixtures thereof.

14. The method according to claim 13 wherein said antistatic agent is selected from the group consisting of (1) monoester sulfosuccinates, (2) diester sulfosuccinates, (3) sulfosuccinamates, (4) ammonium quaternary salts, (5) phosphonium quaternary salts (6) sulfonium quaternary salts, (7) thiazolium quaternary salt, (8) benzothiazolium quaternary salts; and mixtures thereof.

15. The method according to claim 14 wherein said optional filler material is selected from the group consisting of (1) zirconium oxide, (2) colloidal silicas, (3) titanium dioxide, (4) hydrated alumina, (5) barium sulfate, (6) calcium carbonate, (7) high brightness clays, (8) calcium silicate, (9) cellulosics, (10) blend of calcium fluoride and silica, (11) zinc oxide, (12) blends of zinc sulfide with barium sulfate, (13) microspheres and mixtures thereof.

16. The method according to claim 15 wherein said abrasion resistant coating composition is comprised of from about 70 percent by weight to about 90 percent by weight of said hydrophobic binder, from about 0.5 percent by weight to about 20 percent by weight of said antistatic, from about 0.5 percent by weight to about 20 percent by weight of the light fastness inducing agent, and from about 0.5 percent by weight to bout 5 percent by weight of optional filler.

17. The method according to claim 16 wherein the thickness of said second coating is from about 0.1 to about 25 microns.

18. A method of creating simulated photographic-quality images, including the steps of:

forming a reverse reading toner image;

transferring said reverse reading toner image to a transparent substrate;

forming a right reading toner image containing the same information as said reverse reading image;

transferring said right reading toner image to a backing substrate; and adhering said substrates to each other with said images superimposed over each other.

19. The according to claim 17 wherein said steps of transferring toner images comprises transferring them to substrates each of which includes:

a first coating on one side thereof containing (1) a binder selected from the group consisting of (A) polyesters; (B) polyvinyl acetals; (C) vinyl alcohol-vinyl acetal copolymers; (D) polycarbonates; (E)styrene-alkyl alkyl acrylate copolymers and styrene-aryl alkyl acrylate copolymers; (F) styrene-diene copolymers; (G) styrene-maleic anhydride copolymers; (H) styrene-allyl alcohol copolymers; and mixtures thereof; (2) an antistatic agent; (3) an optional filler; and (4) an optional biocide; and a second coating on the another side of said substrates comprised of a hydrophobic abrasion resistant polymeric binder containing a light fastness inducing agent.

20. The method according to claim 18 wherein said xerographically formed images are formed using a toner resin material comprising a colorant and a resin selected from the group consisting of (A) polyesters; (B) polyvinyl acetals; (C) vinyl alcohol-vinyl acetal polymers; (D) polycarbonates; (E) styrene-alkyl alkyl acrylate copolymers and styrene-aryl alkyl acrylate copolymers; (F) styrene-diene copolymers; (G) styrene-maleic anhydride copolymers; (H) styrene-allyl alcohol copolymers; and mixtures thereof.

21. The method according to claim 19 wherein said toner resin material contains the same monomers contained in said binder on said substrates.

* * * * *